US005398494A

United States Patent [19]

Wassenhoven et al.

[11] Patent Number: 5,398,494

[45] Date of Patent: Mar. 21, 1995

[54] SLIVER OPENING DEVICE FOR SEPARATING OUT IMPURITIES AND FEEDING FIBER TO AN OPEN END SPRING MACHINE

[75] Inventors: Heinz-Georg Wassenhoven; Elke Hodenius; Ute Kraehe; Udo Papenfuss, all of Moenchengladbach, Germany

[73] Assignee: W. Schlafhorst AG & Co., Moenchengladbach, Germany

[21] Appl. No.: 136,444

[22] Filed: Oct. 14, 1993

[30] Foreign Application Priority Data

Oct. 14, 1992 [DE] Germany ..... 42 34 587.1

[51] Int. Cl.[6] ..... D01H 4/36; D01H 4/38

[52] U.S. Cl. ..... 57/408; 57/301; 57/406; 57/412

[58] Field of Search ..... 19/200, 202, 203; 57/301, 304, 305, 406, 408, 412

[56] References Cited

U.S. PATENT DOCUMENTS

| | | | |
|---|---|---|---|
| 3,604,194 | 9/1971 | Edagawa et al. | 57/58.89 |
| 3,792,218 | 3/1974 | Landwehrkamp et al. | 57/301 X |
| 4,005,505 | 2/1977 | Roberson | 19/150 |
| 4,024,699 | 5/1977 | Goldammer et al. | 57/412 |
| 4,098,065 | 7/1978 | Stahlecker et al. | 57/58.95 |
| 4,246,745 | 1/1981 | Rehm et al. | 57/408 |
| 4,251,984 | 2/1981 | Ripka et al. | 57/58.91 |
| 4,385,488 | 5/1983 | Raasch et al. | 57/417 |
| 4,461,141 | 7/1984 | Hofmann et al. | 19/112 X |
| 4,590,757 | 5/1986 | Stahlecker | 57/412 |
| 4,854,119 | 8/1989 | Stahlecker et al. | 57/417 |
| 4,976,099 | 12/1990 | Brockmanns et al. | 57/411 |

FOREIGN PATENT DOCUMENTS

| | | |
|---|---|---|
| 1560307 | 4/1971 | Germany . |
| 2314529 | 10/1974 | Germany . |
| 2423241 | 11/1975 | Germany . |
| 2448584 | 4/1976 | Germany . |
| 4008884 | 9/1991 | Germany . |

*Primary Examiner*—Daniel P. Stodola
*Assistant Examiner*—William Stryjewski
*Attorney, Agent, or Firm*—Shefte, Pinckney & Sawyer

[57] ABSTRACT

A sliver opening and fiber feeding device for opening a sliver into individual fibers and feeding the individual fibers to the rotor of an open end spinning machine is provided with a polytetrafluoroethylene coating for the interior surface of the housing of the sliver feeding and opening device, in particular, the trash discharge passage. The polytetrafluoroethylene coating advantageously has a relatively low co-efficient of friction to thereby reduce the affinity of sticky material, which may be present in the sliver due to the presence of insect residue or the like, to stick to the interior surfaces of the device. The polytetrafluoroethylene coating is included on an insert element mounted in the discharge passage, with the insert element being capable of being retrofitted in an existing sliver opening and fiber feeding device.

4 Claims, 5 Drawing Sheets

FIG. 3
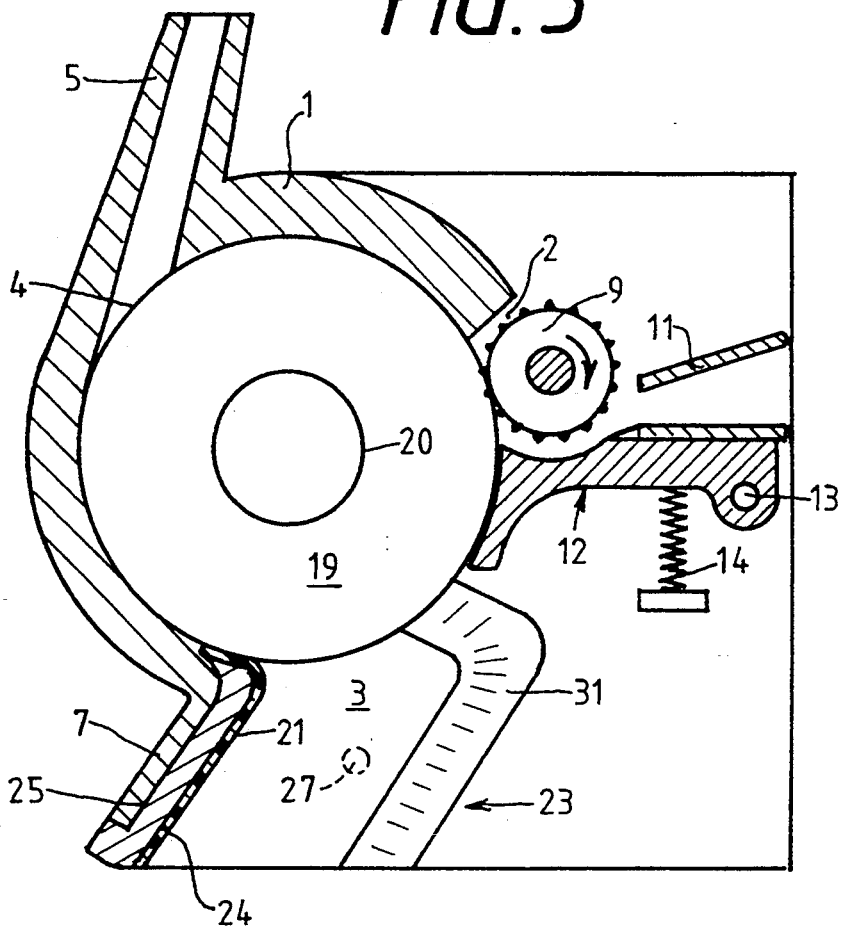
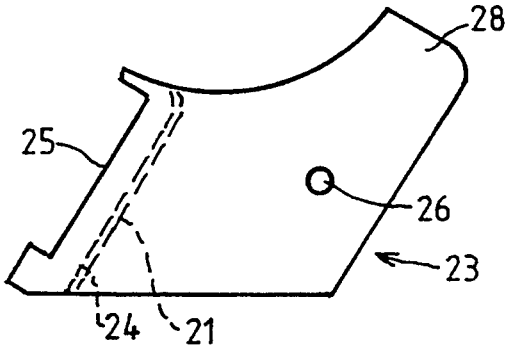
FIG. 4
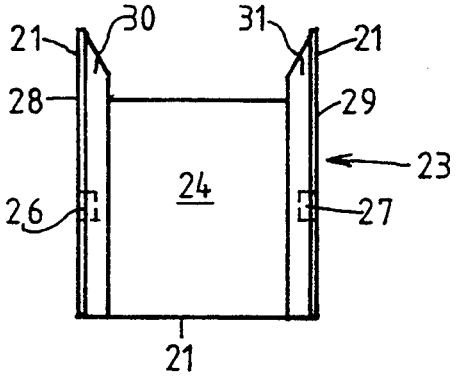
FIG. 5

FIG. 6
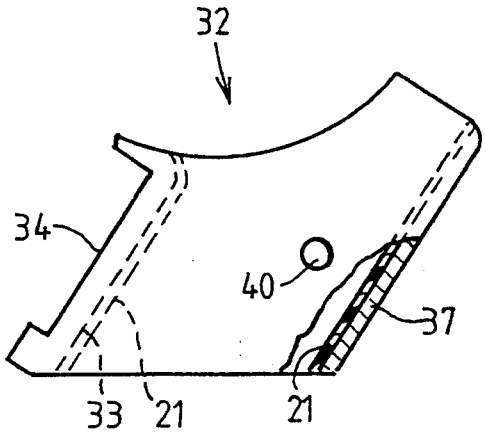
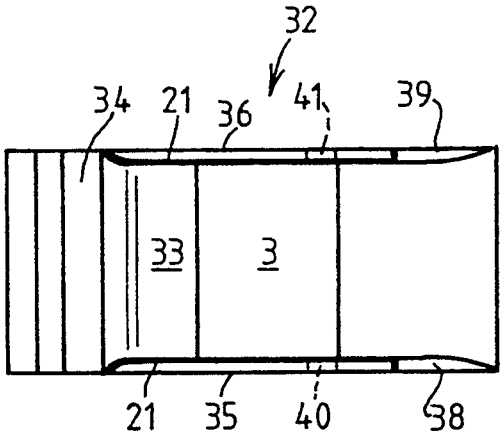
FIG. 7

SLIVER OPENING DEVICE FOR SEPARATING OUT IMPURITIES AND FEEDING FIBER TO AN OPEN END SPRING MACHINE

FIELD OF THE INVENTION

The present invention relates to a device for opening sliver into individual fibers-and for feeding the fibers to the rotor of an open-end spinning machine, and more particularly to such a device having fiber contacting surfaces especially coated to minimize undesirable accumulation on the coated surfaces of sticky material and adhered fibers.

BACKGROUND OF THE INVENTION

In the open-end spinning process, the fibers to be spun are first detached from a sliver, separated, and then spun into a yarn in a spinning unit, for example a rotor, or between two friction drums. The opening of a sliver into individual fibers takes place in so-called opening devices. A roller rotates in such an opening device and has spikes or sawteeth on its circumference for combing the fibers out of the sliver. The sliver is drawn from a can or from a sliver bobbin into the opening device by a sliver feed roller. An intake opening guide plate is pressed against the sliver feed roller with a predetermined spring force. The trash contained in the sliver is forced out by the opening roller and for the most part comes detached from the fibers. Because of the relatively high density of the trash particles compared with the fibers, the trash particles gain higher kinetic energy than the fibers, so that in the gap between the opening roller and the housing, they are carried into the radially outer region of the gap between the roller and the housing wall. This circumstance separates the accelerated trash from the fiber stream, by centrifugal force. To that end, a discharge passage is located below the rollers for discharge of trash therethrough into a collecting container or onto a conveyor belt. The trash, which for instance in natural fibers comprises dust, neps, seed and insect residue and the like, is expelled out through this passage and thus leaves the fiber stream moving toward the fiber guide channel.

While dry trash is relatively easy to expel, problems arise with sticky impurities. If the fibers to be spun are cotton fibers, then impurities can still adhere to the cotton fibers, despite the cleaning of the cotton when the sliver is produced. Impurities from insect residue present special problems. This material consists of sticky excretions from insects that attack the cotton, as well as sticky nectar exuded by the plants. This sticky material makes the fibers adherent and thus makes them difficult to separate in the opening unit. Moreover, sticky material deposits form at points of unfavorable flow conditions. Over time, these sticky material deposits accumulate in the direction of the discharge passage and in certain other regions hindering desirable flow conditions. Moreover, additional trash particles and already-separated fibers can stick to these sticky deposits. The fibers catch other fibers and form tufts of fibers. If these tufts then tear loose and get into the spinning apparatus, they result in yarn flaws. Moreover, the accumulation of sticky material requires frequent manual cleaning of the housing.

Disruptions can arise as soon as a sliver contaminated sticky material is drawn in. As a result of the pressure exerted on the sliver in the region of the intake opening, the sticky impurities are pressed with increasing force against the intake opening and continue to stick there. To avoid these phenomena, it is known from DE 40 08 884 A1 for the intake opening guide plate, at least in the region that comes into contact with the fibers of the sliver, to be coated with a surface layer that comprises a metal layer thermochemically applied to the basic material. With the aid of this apparatus, although it is possible to prevent the deposits on the intake opening guide plate, nevertheless the deposit of sticky material inside the opening device, and in particular in the discharge passage, is not prevented by this provision.

It is also known from DE 24 23 241 C3 for the interior of the housing of an opening device for an open-end spinning system to be lined with wear resistant metal foil. Such lining is composed of rolled, thin-walled metal foil that can be adhesively bonded to the interior of the housing. Such lining is intended to provide wear resistance, not to avoid the accumulation of sticky material.

Polytetrafluoroethylene is known from DE-AS 15 60 307 to be used in lining a rotor of an open-end spinning apparatus in order to promote the deposit of fibers in the collecting groove of the rotor during the spinning process. However, such use of polytetrafluoroethylene is not related to preventing the accumulation of sticky material, as trash is assumed to have been expelled by the time fibers enter the rotor.

Accordingly, the need still exists for an improved sliver opening and fiber feeding device which reduces the risk of sticky material accumulations that disturb or interfere with the spinning process.

SUMMARY OF THE INVENTION

The present invention provides an improved sliver opening and fiber feeding device in which the interior surfaces of the housing which come into contact with trash and sticky material, such as the surfaces of the discharge passage, are coated with a polytetrafluoroethylene plastic material, which can also be applied to other interior surfaces of the housing of the opening device.

Briefly described, the present invention provides a sliver opening and fiber feeding device for opening a sliver into individual fibers and for feeding the fibers to the rotor of an open-end spinning machine, the sliver being of the type in which sticky material may be present due to the presence of insect residue and other natural elements in the sliver.

The device includes a housing having an interior chamber, an intake opening for the intake of sliver into the interior chamber from a sliver feed roller, and an outlet opening for the passage therethrough of separated sliver fibers being fed from the interior chamber to the rotor. An opening roller is rotatably disposed in the interior chamber for rotation in an opening direction to effect opening of the sliver during transport of the sliver between the intake opening and the outlet opening.

The device includes a sliver feed roller rotatably supported on the intake opening and an intake opening guide plate mounted in cooperative relation with the sliver feed roller to form therebetween a contact passageway through which sliver is advanced by the sliver feed roller.

According to the present invention, the housing includes a discharge passage for discharge from the housing of trash separated from the fibers, with the discharge passage having a surface with a coating of polytetrafluoroethylene thereon, to provide resistance to accumulation of sticky material and adhered fibers to the discharge passage. Preferably, the fiber contacting surface portion of the interior chamber of the housing is also coated with polytetrafluoroethylene for the same purpose.

In the preferred embodiment, an insert element is mounted in the discharge passage and forms the discharge passage surface coated with polytetrafluoroethylene. Further preferably, the insert is formed of thin metal sheet material such that it can be retrofitted in an existing sliver-feeding and opening device.

The surface coating according to the invention advantageously provides an anti-adhesion coating because it is dense and has no pores. Moreover, the surface is very smooth and as a result has a very low coefficient of friction. Thus mechanical adhesion to the surface is not afforded for the trash. Both the chemical structure and the surface structure moreover afford the trash only very slight capabilities of adhesion.

Plastics based on polytetrafluoroethylene are used for surface coating wherever it is important to make very good sliding properties at high temperatures of up to approximately 250° possible. The achievement of this invention is that surfaces with a coating with the aforementioned plastic material unexpectedly have the previously unrecognized property of having no or only very slight adhesion to the sticky material.

Not only the discharge passage but also the surfaces of the housing that come into contact with the fibers may be provided with this coating. In the chamber in which the opening roller rotates, the circumferential wall opposite the opening roller may be coated. The coating also reduces frictional resistance during transport of the fibers.

The use of an insert according to the preferred embodiment of the present invention makes it possible for this insert to be economically coated separately only in the region that comes into contact with the trash. If wear occurs, the element can be replaced, and moreover existing opening devices can be economically retrofitted with this insert.

BRIEF DESCRIPTION OF THE DRAWINGS

FIG. 3 is a vertical sectional view of an opening device in which according to the preferred embodiment of the present invention an insert is disposed in the discharge passage with a coating of polytetrafluoroethylene plastic material thereon;

FIG. 4 is a side elevational view of the insert of FIG. 3;

FIG. 5 is an end elevational view of the insert of FIG. 4;

FIG. 6 is a side elevational view of a modified insert of the type illustrated in FIG. 5;

FIG. 7 is a plan view of the insert of FIG. 4; and

DETAILED DESCRIPTION OF THE PREFERRED EMBODIMENT

Figure 1:
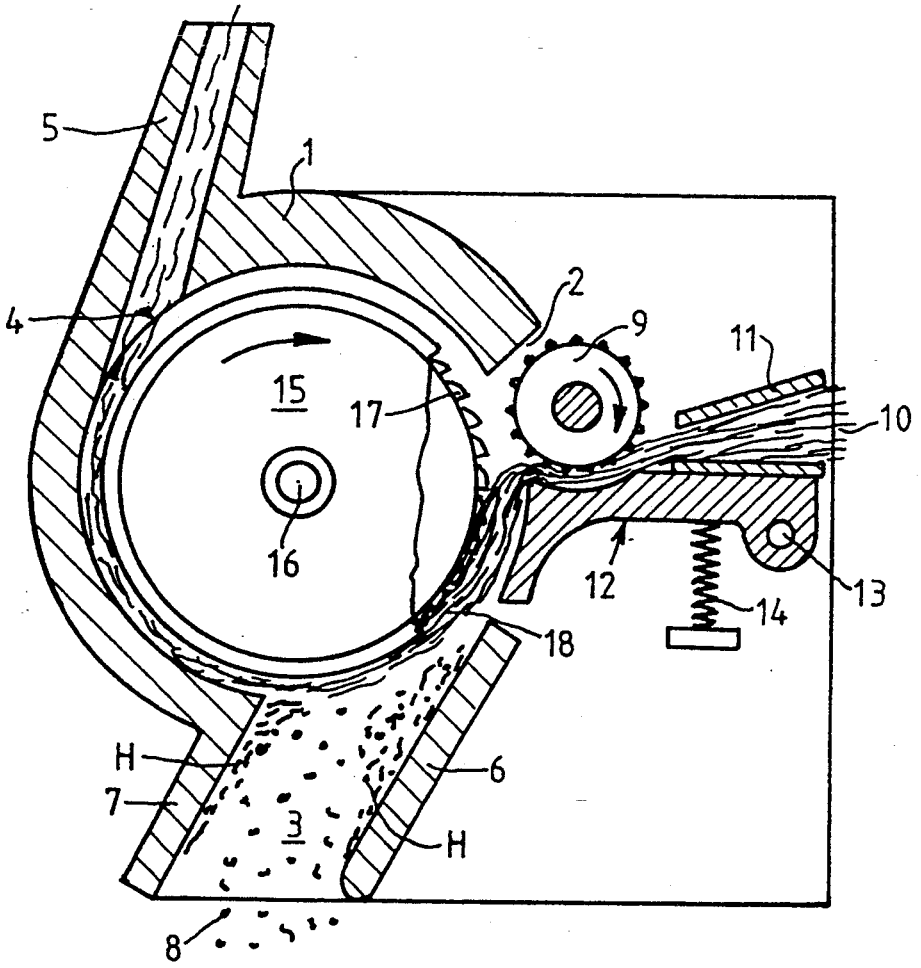
FIG. 1 (Prior Art)
FIG. 1 is a vertical sectional view of an opening device of a conventional spinning unit of an open-end spinning machine.

FIG. 1 shows an opening device of a conventional open-end spinning machine having a housing 1 with an intake opening 2 for the sliver to be opened, and a trash passage 3 and a fiber feeding opening 4 for feeding the combed-out, separated fibers to the spinning station, not shown, through a fiber guide passage 5. The trash discharge passage 3 is defined by the housing side wall and by the surfaces of the walls 6 and 7, which are part of the housing 1.

The trash discharge passage 3 leads to a collecting or removal system, not shown, for the expelled trash particles 8.

A sliver feed roller 9, which rotates in the direction of the arrow, draws a sliver 10 under a compressor plate 11 via a movable intake opening guide plate 12 into the intake opening 2 of the housing 1. The intake opening guide plate 12 is pivotably supported on the housing wall about a pivot 13 and urged by a spring 14 against the sliver feed roller 9. If the condition of the sliver 10, for instance its thickness, varies, then the intake opening guide plate 12 is deflected accordingly.

In the housing 1, an opening roller 15 rotates in the direction of the arrow about its axis 16, which is supported in the housing 1. On its circumference, the opening roller 15 has a plurality of sawtooth-like combing elements 17, about its outer circumference. These combing elements 17 comb individual fibers 18 out of the delivered sliver 10. As a result of airflow induced in the housing 1, the separated fibers 18 are entrained by the air flow and carried through the fiber guide passage 5 to the spinning unit. The trash 8 expelled from the stream of individual fibers 18 normally has a greater mass than the fibers and is therefore expelled centrifugally from the fibers into the trash discharge passage 3.

Sticky material, in particular insect residue, can become deposited, however, especially at the points of concentrated flow. Hence accumulation of sticky material deposits H occurs in the trash discharge passage 3 on the surfaces of the walls 6 and 7 in conventional devices such as illustrated in FIG. 1. Growth of the deposits impairs effective discharge of the trash and means longer downtimes because of more-frequent stoppage for cleaning.

Figure 2:
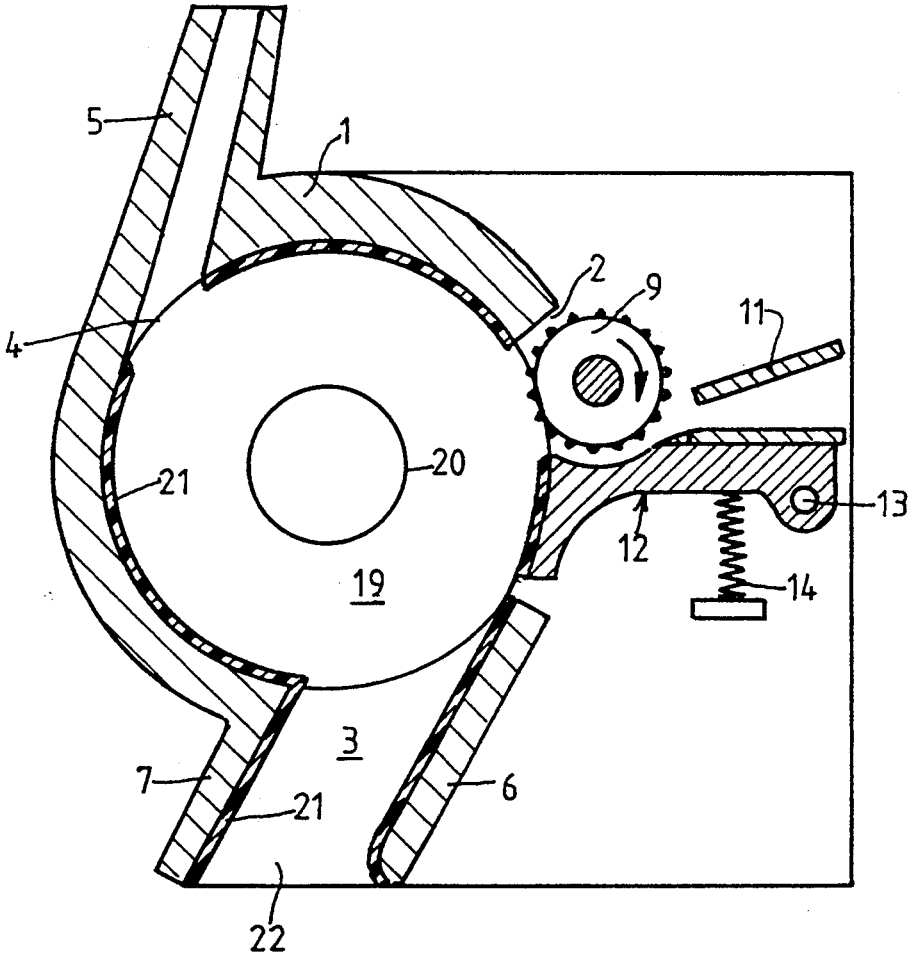
FIG. 2 is a vertical sectional view of an opening device in which the surface opposite the circumferential surface of the opening roller and the surface of the trash discharge passage are coated in accordance with the present invention with polytetrafluoroethylene plastic material.

FIG. 2 shows an opening device according to the present invention, which in its essential structural characteristics is identical to the conventional opening device of FIG. 1. For this reason, the same reference numerals are used as in FIG. 1.

In FIG. 2, the sliver, the opening roller, and the separated fibers have been omitted for the sake of clearly illustrating the invention. In the chamber 19 of the housing 1, the opening 20 through which the shaft of the opening roller is passed can be seen. Moreover, because of the section taken through the housing wall, it can be seen that at least the circumferential surface of the interior chamber 19 opposite the opening roller, as well as the surfaces of the walls 6 and 7 of the trash discharge passage 3, are in accordance with the present invention equipped with a coating of polytetrafluoroethylene based plastic material. In the trash discharge passage 3, not only the surfaces of the walls 6,7 but also the side surfaces are coated in accordance with the invention, because they do come into contact with the trash.

The coating of the surfaces may be done by an immersion process or a spraying process, and the applied layer is subsequently subjected to a heat treatment. The layer is only a few micrometers thick and has no pores.

FIGS. 3–5 show a further feature of the opening device according to the invention in which an insert 23 is disposed in the trash discharge passage 3 to provide the primary trash contacting surface 24 at the leading side thereof against which trash impacts.

The insert 23 has flanges 25 projecting outwardly from the surface 24 such that it can be retained in the passage 3. Besides this fixation, further fastening may be provided by means of screws, which engage holes 26 and 27 of side walls 28 and 29 of the U-shaped insert through the side wall of the housing 1. The interior surfaces of the U-shaped insert are provided with the polytetrafluoroethylene coating 21 according to the invention. In FIG. 3, the coating 21 is shown in section on the primary trash contacting surface 24, with the coating extending as far as the edges of the side walls 28 and 29.

To avert sharp edges and unevenness that could form attachment points for the sticky material deposits, the side walls 28 and 29 are provided toward the side walls of the housing with chamfers 30 and 31, respectively, which in accordance with the invention are likewise provided with the polytetrafluoroethylene coating.

A trash discharge passage in the form of a chute enclosed on all sides by walls, in accordance with a modification of the version of FIG. 2, can also be embodied as an interchangeable element. FIG. 6 shows a side view and FIG. 7 an elevation view of a chute-like insert 32. As in the preceding preferred embodiment the primary trash contacting wall 33 has mounting flanges 34, which surround the wall 7 of the housing 1. The surfaces of the wall 33, the side walls 35,36, and the closure end 37 are lined on the inside with the polytetrafluoroethylene-based anti-adhesion coating 21, in accordance with the invention. The side walls 35,36 have chambers 38,39, which are likewise coated. As in the preceding embodiment, they serve to avert sharp edges and shoulders at which trash could settle. The side walls 35 and 36 have blind bores 40 and 41 on their outside. As in the preceding embodiment, these bores serve the purpose of fixation of the insert by means of screws, which are installed through the side walls of the housing 1.

Figure 8:
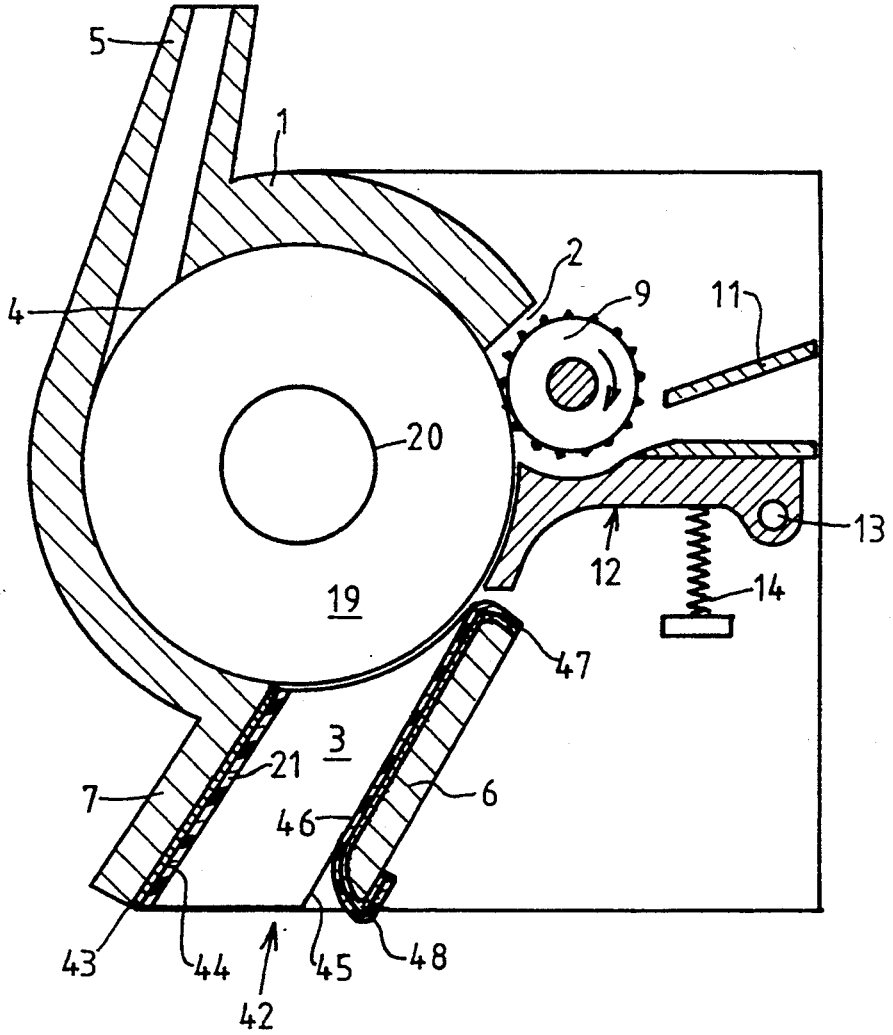
FIG. 8 is a vertical sectional view of an opening device in which a thin sheet metal insert of the present invention is retrofitted in a device.

FIG. 8 shows a preferred embodiment in which the insert 42 is in the form of a chute 43 formed of thin metal sheet material. Each of the four walls of the chute, of which only the three walls 44,45,46 can be seen, is provided on its interior surface with the coating 21 of polytetrafluoroethylene material. This insert can be fitted in the trash discharge passage 3 of existing opening devices. The fixation is done very simply by flanging over the wall 46 at 47 and 48. These flanged-over portions circumferentially engage the wall 6 of the housing 1 of the opening device.

An economical way of attaining the invention is to embody the trash discharge passage as an interchangeable insert 23. This can be manufactured separately and can also be coated separately. This means that expensive coatings of the surfaces of the chamber 19 that do not come into contact with the trash can be avoided. Moreover, already existing chambers can be retrofitted by this provision. Furthermore, the use of a coated insert is also advantageous because the main concentration of sticky material occurs in the region of the trash discharge passage, which is thus the location where deposits of sticky material are most likely to form. If the coating should become damaged by wear, then the insert can be readily replaced, without requiring that the entire opening device be replaced.

It is also possible that only the surface of the housing 1 in the region of the chamber 19 that extends as a circumferential wall from the trash discharge passage 3 to the feeding opening 4 be coated. This portion could likewise be interchangeable.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A device for opening sliver into individual fibers and for feeding the fibers to a rotor of an open-end spinning machine, said device comprising:

a housing having an interior chamber, an intake opening for the intake of sliver into said interior chamber, and an outlet opening for the passage therethrough of separated sliver fibers being fed from said interior chamber to the rotor;

an opening roller rotatably disposed in said interior chamber for rotation in an opening direction to effect opening of sliver during transport of the sliver between said intake opening and said outlet opening;

a sliver feed roller rotatably supported on said intake opening;

an intake opening guide plate mounted in cooperative relation with said sliver feed roller to form therebetween a contact passage through which sliver is advanced by the sliver feed roller; and said housing including means for resisting any sticky trash material composed of insect residue or other material in the sliver separated from the fibers of the sliver; said housing having a discharge passage for discharge from the housing of trash material separated from the fibers, said resisting means defining a surface in said discharge passage with a coating of polytetrafluorethylene.

2. A sliver opening and fiber feeding device according to claim 1 wherein said interior chamber has a fiber contacting surface portion with a coating of polytetrafluoroethylene thereon.

3. A sliver opening and fiber feeding device according to claim 1 and characterized further by an insert element mounted in said discharge passage and forming said discharge passage surface with said coating of polytetrafluoroethylene thereon.

4. A sliver opening and fiber feeding device according to claim 3 wherein said insert is formed of thin metal sheet material capable of being retrofitted in an existing sliver feeding and opening device.

* * * * *